US008111277B2

(12) United States Patent
Yokoi et al.

(10) Patent No.: US 8,111,277 B2
(45) **Date of Patent: *Feb. 7, 2012**

(54) IMAGE FORMING APPARATUS WITH A PLURALITY OF EXPOSURE UNITS

(75) Inventors: Junichi Yokoi, Toyoake (JP); Takuya Yamaguchi, Toyokawa (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/909,880

(22) Filed: Oct. 22, 2010

(65) Prior Publication Data

US 2011/0037823 A1 Feb. 17, 2011

Related U.S. Application Data

(63) Continuation of application No. 12/340,778, filed on Dec. 22, 2008, now Pat. No. 7,843,483.

(30) Foreign Application Priority Data

Dec. 27, 2007 (JP) ..... 2007-335638

(51) Int. Cl.
*B41J 2/435* (2006.01)

(52) U.S. Cl. ..... 347/245; 347/263

(58) Field of Classification Search ..... 347/138, 347/145, 152, 237, 238, 242, 245, 257, 263
See application file for complete search history.

(56) References Cited

U.S. PATENT DOCUMENTS

| | | | | |
|---|---|---|---|---|
| 4,975,858 | A * | 12/1990 | Ikenoue et al. | 358/1.18 |
| 5,808,649 | A | 9/1998 | Shimanari et al. | |
| 5,978,626 | A | 11/1999 | Nagamine et al. | |
| 6,038,417 | A | 3/2000 | Nagamine et al. | |
| 6,219,508 | B1 | 4/2001 | Nagatomi et al. | |
| 6,778,197 | B2 | 8/2004 | Yamanaka | |
| 6,907,206 | B2 | 6/2005 | Hattori et al. | |

(Continued)

FOREIGN PATENT DOCUMENTS

JP 05-278266 10/1993

(Continued)

OTHER PUBLICATIONS

JP Office Action dated Nov. 15, 2011, corresponding Application No. 2007-335638; English Translation.

*Primary Examiner* — Hai C Pham
(74) *Attorney, Agent, or Firm* — Banner & Witcoff, Ltd

(57) ABSTRACT

An image forming apparatus includes: a lower body including a plurality of photosensitive members and having an opening; an upper body which is configured to open and cover the opening; a plurality of exposure units which are supported by the upper body and which are opposed to the photosensitive members when the cover covers the opening; a main substrate provided in the housing; an exposure control substrate which is provided to the upper body and controls light emission of the exposure units; a plurality of first cables which electrically connect the exposure units to the exposure control substrate, respectively, each of the first cables including a plurality of signal lines; and a second cable which electrically connects the exposure control substrate to the main substrate and which includes at least one signal line, a number of which is smaller than a total number of the signal lines included in the first cables.

8 Claims, 4 Drawing Sheets

U.S. PATENT DOCUMENTS

| | | | | |
|---|---|---|---|---|
| 7,388,593 | B2 | 6/2008 | Fukuda | |
| 7,843,483 | B2 * | 11/2010 | Yokoi et al. | 347/245 |
| 2008/0219697 | A1 | 9/2008 | Itabashi | |
| 2008/0259364 | A1 | 10/2008 | Morita et al. | |

FOREIGN PATENT DOCUMENTS

| | | |
|---|---|---|
| JP | 11-153893 | 6/1999 |
| JP | 2005131963 A | 5/2005 |
| JP | 2007-065125 | 3/2007 |

* cited by examiner

IMAGE FORMING APPARATUS WITH A PLURALITY OF EXPOSURE UNITS

CROSS-REFERENCE TO RELATED APPLICATIONS

This application is a continuation of co-pending U.S. application Ser. No. 12/340,778, filed Dec. 22, 2008, which claims priority from Japanese Patent Application No. 2007-335638, filed on Dec. 27, 2007, the entire subject matter of which is incorporated herein by reference.

TECHNICAL FIELD

Aspects of the present invention relate to an image forming apparatus having a plurality of exposure units configured to be opposed to photosensitive members.

BACKGROUND

In a related-art image forming apparatus, a plurality of LED heads that generate electrostatic latent images on photosensitive drums are held by a pivotable upper cover by way of a holding member. In association with pivoting movement of the upper cover, the LED heads are moved from exposure positions where the LED heads expose the photosensitive drums with light and retracted positions where the LED heads are separated from the photosensitive drums (see; for example, JP-A-2007-65125). In such an image forming apparatus, a control substrate that controls light emission of the LED heads on the basis of data pertaining to an image to be generated is provided in an apparatus main body, and the control substrate of the apparatus main body and the respective LED heads of the upper cover are electrically connected together via respective cables.

In the related-art image forming apparatus, a plurality of cables are laid over a long distance from the control substrate of the apparatus main body to the LED heads of the upper cover. Through these cables connecting the control substrate and the LED heads, power for driving the LED heads is supplied to the LED heads as well as a signal, such as an image data. Therefore, the cables supply a larger amount of power as compared with a cable for supplying only a signal.

Noise arising in the high-power cable greatly affects adjacent cable or other members. Therefore, the cable is usually shielded with a shield member, such as aluminum. However, such a shield member is expensive.

Moreover, since a plurality of cables are laid over a long distance from the control substrate of the apparatus main body to the LED heads of the upper cover, a space for laying (routing) the plurality of cables has to be ensured in the apparatus main body and the upper cover, which raises a problem of complication of wiring.

SUMMARY

Exemplary embodiments of the present invention address the above disadvantages and other disadvantages not described above. However, the present invention is not required to overcome the disadvantages described above, and thus, an exemplary embodiment of the present invention may not overcome any of the problems described above.

Accordingly, it is an aspect of the present invention to provide an image forming apparatus that has a high-power cable shorter than a related-art cable and that is simply wired.

According to an exemplary embodiment of the present invention, there is provided an image forming apparatus including: an lower body including a plurality of photosensitive members and having an opening; a upper body which is configured to open and cover the opening; a plurality of exposure units which are supported by the upper body and which are opposed to the photosensitive members when the upper body covers the opening; a main substrate provided in the housing; an exposure control substrate which is provided to the upper body and controls light emission of the plurality of exposure units; a plurality of first cables which electrically connect the exposure units to the exposure control substrate, respectively, each of the first cables including a plurality of signal lines; and a second cable which electrically connects the exposure control substrate to the main substrate and which includes at least one signal line, a number of which is smaller than a total number of the signal lines included in the plurality of first cables.

BRIEF DESCRIPTION OF THE DRAWINGS

The above and other aspects of the present invention will become more apparent and more readily appreciated from the following description of exemplary embodiments of the present invention taken in conjunction with the attached drawings, in which.

DETAILED DESCRIPTION

Figure 1:
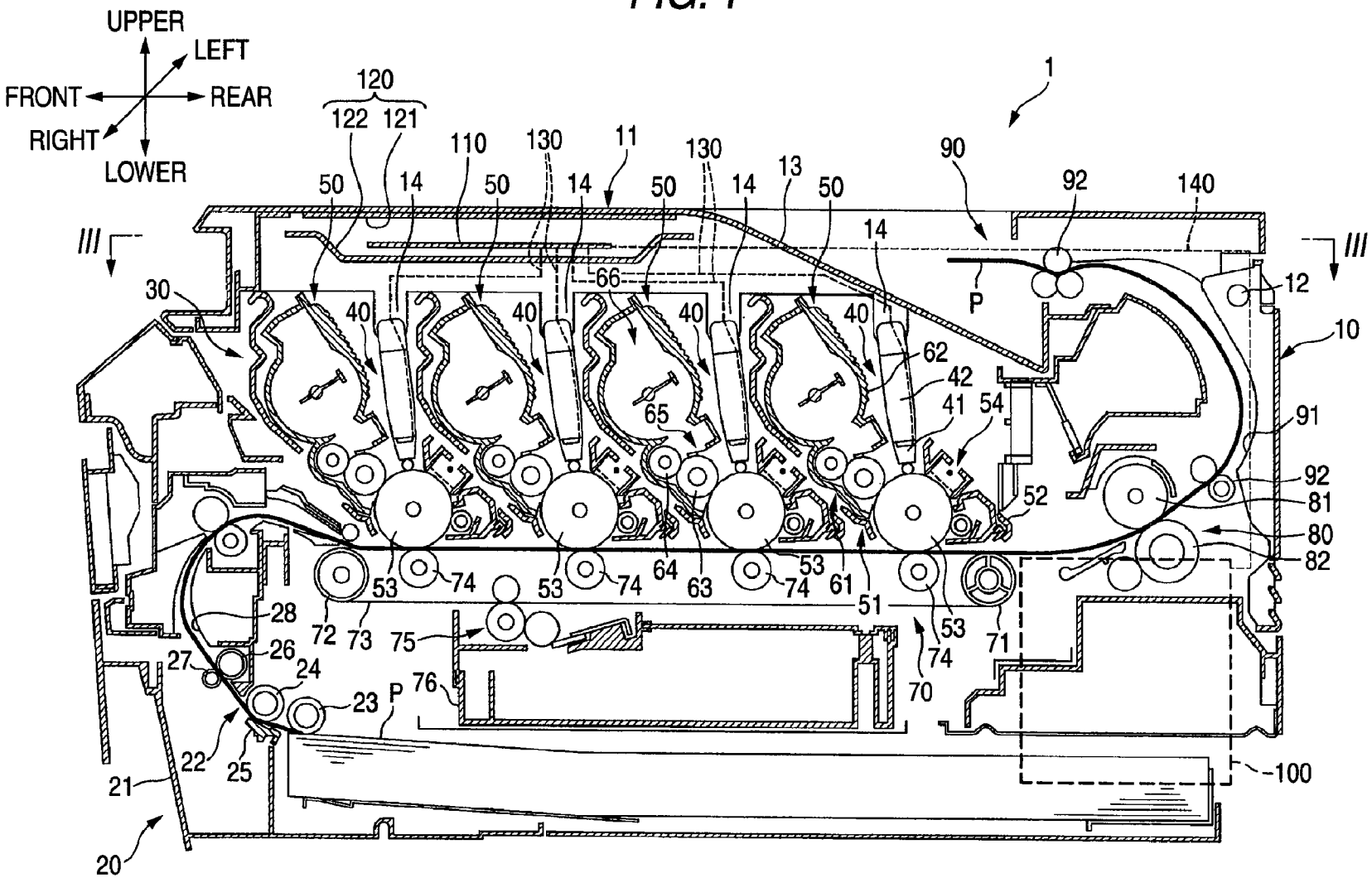
FIG. 1 is a cross-sectional view showing an overall configuration of a color printer.

An exemplary embodiment of the present invention will now be described in detail with reference to the drawings. In the drawings, FIG. 1 is a cross-sectional view showing the overall configuration of a color printer, and FIG. 2 is cross-sectional view showing the color printer in which an upper cover is opened.

In the following descriptions, directions will be described by reference to user's directions when the color printer is in use. Specifically, in FIG. 1, the left side of the sheet is taken as "front"; the right side of the sheet is taken as "rear"; a direction away from the viewer in the sheet is taken as "left"; and a direction toward the viewer in the sheet is taken as "right." The vertical direction of the sheet is taken as the "vertical (upper and lower) direction."

As shown in FIG. 1, a color printer 1 has, within a main housing 10, a sheet feeding section 20 for feeding a sheet P; an image forming section 30 for forming an image on the thus-fed sheet P; a sheet discharging section 90 that discharges the sheet P on which an image is formed; and a main substrate 100 for controlling the respective sections at the time of formation of an image. The main housing 10 has an opening 10A at an upper portion thereof.

Figure 2:
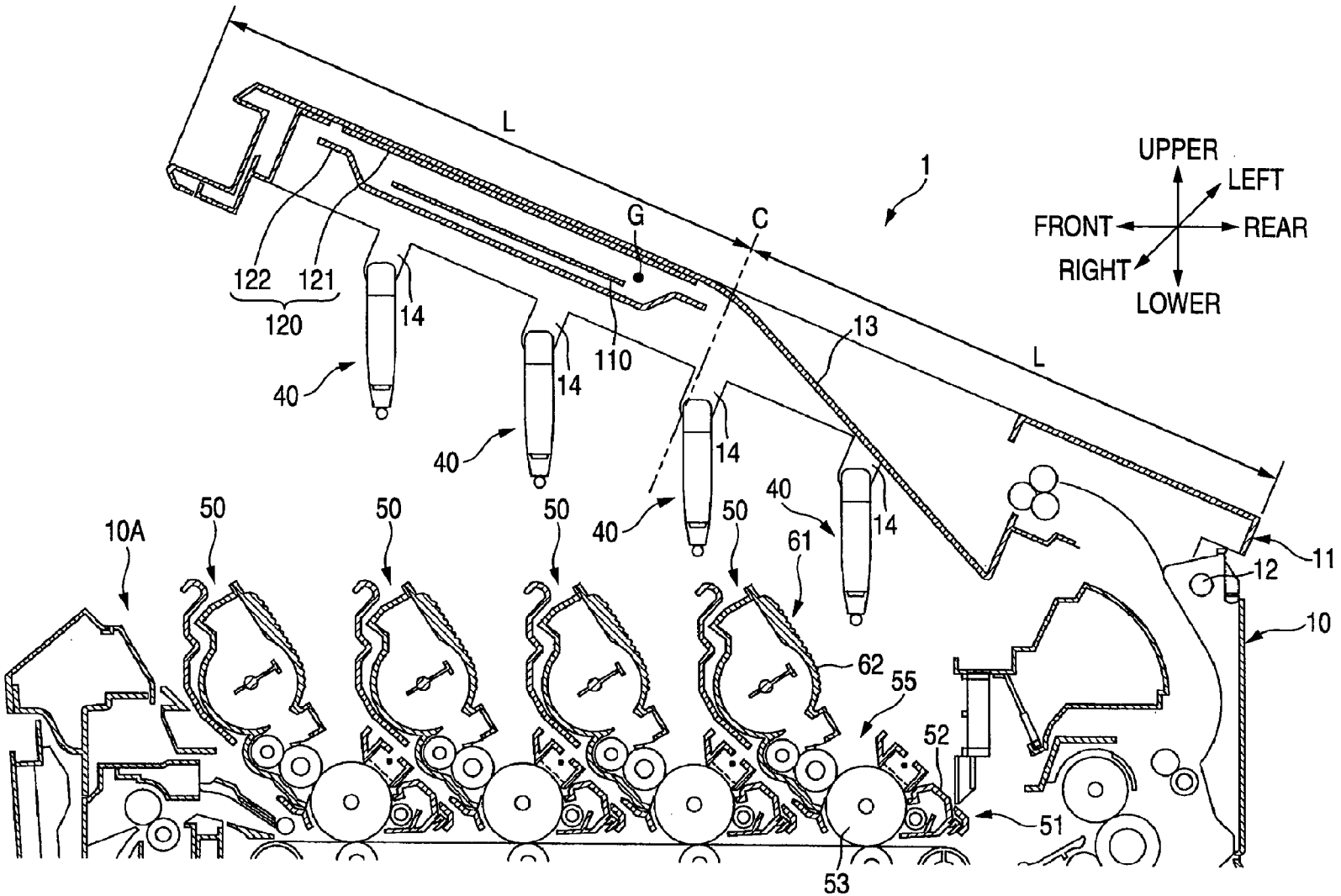
FIG. 2 is a cross-sectional view showing the color printer in which an upper cover is opened.

As shown in FIG. 2, an upper cover 11 that is configured to open and cover the opening 10A of the main housing 10 is provided at the upper portion of the main housing 10. The upper cover 11 is vertically pivotable about a rotary shaft 12 provided at a rear side of the main housing 10. As shown in FIG. 1, an upper surface of an upper cover 11 constitutes a sheet discharging tray 13 on which the sheets P discharged from the main housing 10 is stacked. A lower surface of the upper cover 11 is provided with a plurality of holding members 14 which hold (support) LED units 40. An LED control substrate 110 and a shield plate 120 opposing the LED control substrate 110 are provided inside of the upper cover 11.

The sheet feeding section 20 includes a sheet feeding tray 21 that is provided in a lower inner portion of the main housing 10 and that is removably attached to the main housing 10; and a sheet feeding mechanism 22 that conveys the sheets P from the sheet feeding tray 21 to an image forming section 30. The sheet feeding mechanism 22 is provided on the right side of the sheet feeding tray 21 and includes a feed roller 23, a separation roller 24, and a separation pad 25.

In the sheet feeding section 20 configured as mentioned above, the sheets P loaded in the sheet feeding tray 21 are separated one at a time and fed upwardly. After paper powder is removed during the course of the sheet passing between a paper powder removal roller 26 and a pinch roller 27, the sheet passes through a conveyance path 28, to thus be turned back and fed to the image forming section 30.

The image forming section 30 includes the four LED units 40; four process cartridges 50; a transfer unit 70; and a fixing unit 80.

The LED units 40 are disposed above the respective photosensitive drums 53. Each of the LED units 40 includes an LED head 41 and a frame 42. The LED heads 41 are disposed to be opposed to the respective photosensitive drums 53.

A plurality of light-emitting diodes (LEDs, not shown) are arranged in a right-and-left direction on the surface of the LED head 41 to be opposed to the photosensitive drum 53. Each of the LEDs receives an input signal from an LED control substrate 110, which will be described later, on the basis of data pertaining to an image to be formed, to thus illuminate and expose the surface of the photosensitive drum 53.

The frame 42 covers the LED head 41 and attached in a pivotable manner to the upper cover 11 through a holding member 14. As a result, as shown in FIG. 2, the LED unit 40 (the LED head 41) is moved from an exposure position where the LED unit opposes the photosensitive drum 53, to an upper retracted position upwardly pivoting the upper cover 11.

As shown in FIG. 1, the process cartridges 50 are aligned in a longitudinal direction while being sandwiched between the upper cover 11 and the sheet feeding section 20, and each of the process cartridges 50 includes a drum unit 51 and a developing unit 61 removably attached to the drum unit 51. The process cartridge 50 can be replaced through the opening 10A of the main housing 10 after the upper cover 11 is pivoted upwardly (see FIG. 2). The process cartridges 50 differ from each other only in terms of the color of toner (a developing agent) housed in a toner housing chamber 66 of a developing unit 61 and are identical with each other in terms of a structure.

Each of the drum units 51 includes a drum case 52; a photosensitive drum 53 rotatably supported by the drum case 52; and an electrifier 54.

As a result of the developing unit 61 being attached to the drum case 52, an exposure space 55 (see FIG. 2) through which the photosensitive drum 53 is viewed from the outside is defined. The LED unit 40 (the LED head 41) is inserted into the exposure space 55 so as to oppose an upper area of the surface of the photosensitive drum 53.

The developing unit 61 has a case 62; a developing roller 63 and a supply roller 64 that are rotatably supported by the case 62; and a blade assembly 65. Further, the developing unit 61 has a toner housing chamber 66 that houses toner.

As shown in FIG. 1, a transfer unit 70 is interposed between the sheet feeding section 20 and the respective process cartridges 50. The transfer unit 70 includes a drive roller 71, a driven roller 72, a conveyance belt 73, a transfer roller 74, and a cleaning section 75.

The drive roller 71 and the driven roller 72 are provided in parallel while being spaced apart from each other in the longitudinal direction. The conveyance belt 73 formed from an endless belt is wound around the drive roller 71 and the driven roller 72. An external surface of the conveyance belt 73 is in contact with the respective photosensitive drums 53. Four transfer rollers 74 that nip the conveyance belt 73 in conjunction with the respective photosensitive drums 53 are disposed inside of the conveyance belt 73 so as to oppose the respective photosensitive drums 53. A transfer bias voltage is applied to the transfer rollers 74 by constant current control operation performed during transfer.

The cleaning section 75 is disposed below the conveyance belt 73 and configured so as to remove the toner adhering to the conveyance belt 73 and cause the thus-removed toner to fall into a toner reservoir section 76 disposed below the cleaning section 75.

The fixing unit 80 is disposed at the rear of the respective process cartridges 50 and the transfer unit 70 and includes a heating roller 81 and a pressing roller 82 that is disposed opposite the heating roller 81 and presses the heating roller 81.

In the image forming section 30 configured as mentioned above, surfaces of the respective photosensitive drums 53 are uniformly charged by the electrifiers 54 and subsequently exposed to LED light emitted from the respective LED heads 41. Thereby, the electric potential of exposed areas becomes lower, and electrostatic latent images based on image data are formed on the respective photosensitive drums 53.

The toner in the toner housing chamber 66 is supplied to the developing roller 63 by rotation of the supply roller 64, and the thus-supplied toner enters a space between the developing roller 63 and the blade assembly 65 by rotation of the developing roller 63, whereupon the toner is held on the developing roller 63 as a thin layer of specific thickness.

The toner held on the developing roller 63 is supplied to the electrostatic latent image formed on the photosensitive drum 53 when the developing roller 63 contacts the photosensitive drum 53 in an opposing manner. Thereby, the toner is selectively held on the photosensitive drum 53, so that the electrostatic latent image is visualized and that a toner image is generated by this reversal development.

In the course of the sheet P fed on the conveyance belt 73 passing between the respective photosensitive drums 53 and the respective transfer rollers 74 disposed inside of the conveyance belt 73, the toner images formed on the respective photosensitive drums 53 are sequentially transferred to the sheet P. When the sheet P passes between the heating roller 81 and the pressing roller 82, the toner images transferred onto the sheet P are thermally fixed.

The sheet discharging section 90 includes a sheet discharging path 91 that is formed so as to upwardly extend from an exit of the fixing unit 80 and turn to the right side and a plurality of conveyance roller pairs 92 for conveying the sheet P. The sheet P on which the toner images are transferred and thermally fixed is conveyed along the sheet discharging path 91 by the conveyance rollers 92, discharged to the outside of the main housing 10, and stacked on the sheet discharging tray 13.

Figure 3:
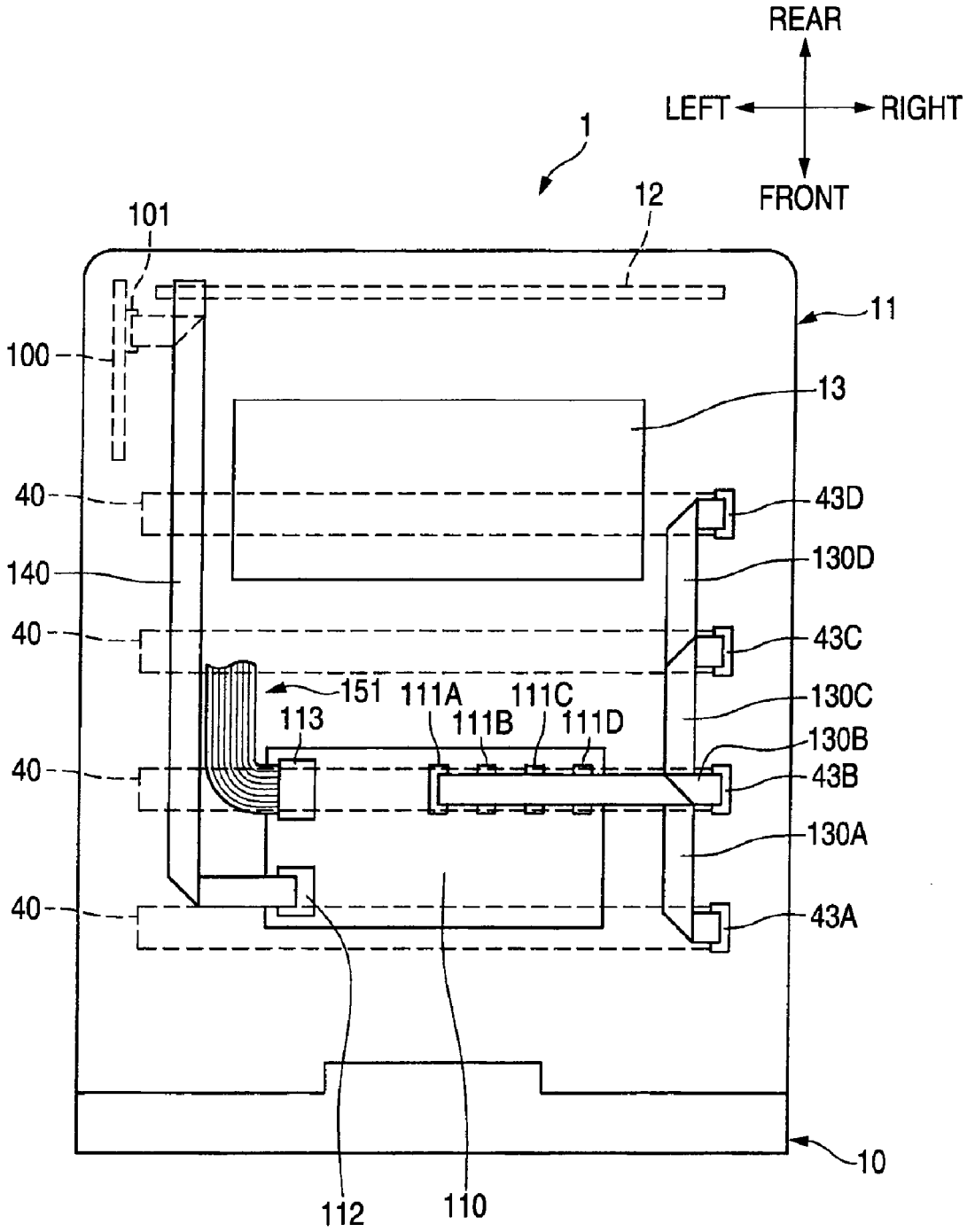
FIG. 3 is a cross-sectional view taken along line III-III shown in FIG. 1.
Figure 4:
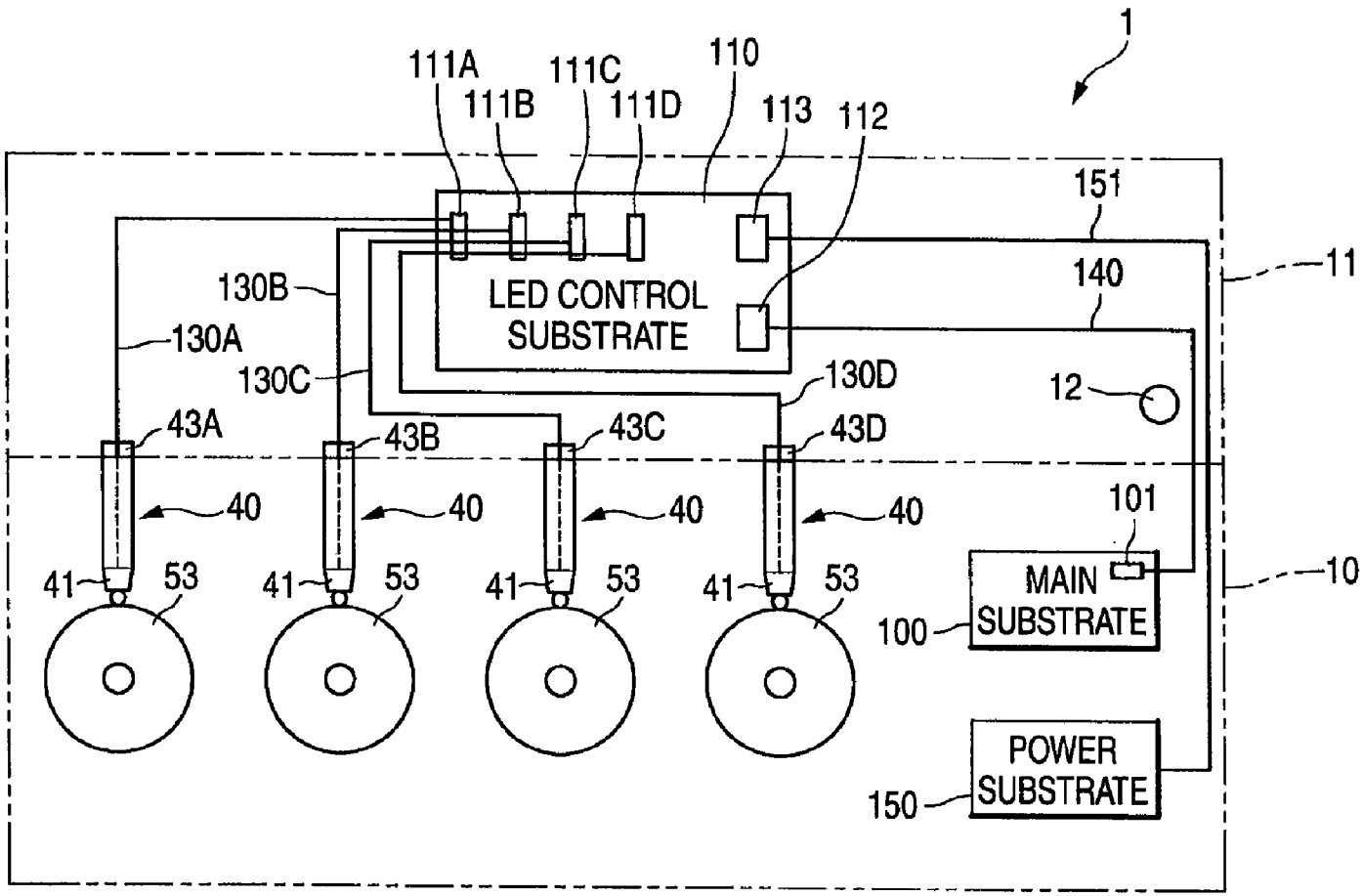
FIG. 4 is a schematic diagram showing a wiring configuration in a main control substrate and an LED control substrate and an LED head.

A wiring configuration in the main substrate 100, the LED control substrate 110 and the LED heads 41 will now be described. FIG. 3 is a cross-sectional view taken along line III-III shown in FIG. 1, and FIG. 4 is a schematic view showing the wiring configuration in the main substrate, the LED control substrate and the LED heads.

The main substrate 100 is configured to control respective sections of the color printer 1 during image forming operation by means of a related-art technique. Specifically, the main substrate 100 directly controls or indirectly controls, through another control substrate (e.g., the LED control substrate 110), rotational speeds of the photosensitive drums 53 and the drive roller 71, the conveyance speed of the sheet P achieved at the sheet feeding section 20 and at the fixing unit 80, and illumination timings of the respective LEDs. As shown in FIGS. 1 and 3, the main substrate 100 is arranged to stand upright along a rear lower portion of the left side surface in the main housing 10, that is, a substrate surface (a circuit surface) of the substrate is oriented in the right-to-left direction.

By a related-art technique, the LED control substrate 110 outputs signals to the respective LEDs of the respective LED heads 41 on the basis of data pertaining to an image to be formed, thereby controlling illumination (light emission) of the LEDs. As shown in FIG. 2, the LED control substrate 110 is disposed at the front interior side of the upper cover 11 so that the centroid G of the upper cover 11 is positioned at more front than the center C located at an equidistance L from the front end and the rear end of the upper cover 11. In other words, the centroid G of the upper cover 11 is positioned between the front end thereof and the center C thereof. As a result, the LED control substrate 110 acts as a weight, so that the upper cover 11 can be closed firmly. The centroid of the LED control substrate 110 is also positioned more front than the center C of the upper cover 11 shown in FIG. 2.

The shield plate 120 is a plate material made of metal and shields noise, such as electromagnetic waves, arising in the LED control substrate 110. As shown in FIG. 1, the shield plate 120 includes an upper shield plate 121 disposed at the front side of the upper cover 11 and that opposes an upper surface of the LED control substrate 110 and a lower shield plate 122 that opposes a lower surface of the LED control substrate 110.

Emission of noise to outside, such as electromagnetic waves, arising in the LED control substrate 110 can be prevented by providing the shield plate 120. Further, the shield plate 120 formed from metal serves as a reinforcement member, to thus enable enhancement of the strength of the upper cover 11. Further, the shield plate 120 is disposed so as to oppose upper and lower surfaces of the LED control substrate 110. Therefore, the shield plate 120 made of metal acts as a weight in conjunction with the LED control substrate 110, so that the upper cover 11 can be closed firmly.

As shown in FIG. 3, the respective LED units 40 (the respective LED heads 41) and the LED control substrate 110 are electrically connected with each other via flat cables 130 including a plurality of flat cables 130A to 130D. The LED control substrate 110 and the main substrate 100 are electrically connected with each other via a single flat cable 140.

Each of the flat cables 130 (130A to 130D) is a single cable formed by tying signal lines covered with an insulating resin coating into a bundle having a belt shape. One end of each of the flat cables 130A to 130D is connected to the respective one of connectors 111A to 111D provided on the LED control substrate 110. The flat cables are drawn rightwardly from the right end portion of the LED control substrate 110 and bent as necessary. The other end of each of the flat cables 130A to 130D is connected to the respective one of connectors 43A to 43C provided on the LED unit 40. The respective connectors 43A to 43D are electrically connected to the respective LED heads 41 via the frame 42.

The flat cable 140 is a single cable formed by tying signal lines covered with an insulating resin coating are into a bundle having a belt shape. Although unillustrated, the total number of the signal lines included in the flat cable 140 is smaller than the total number of the signal lines included in the four flat cables 130. Further, the flat cable 140 is different from the flat cable 130 in terms of a data transfer rate achieved per line and a protocol to be used therein.

One end of the flat cable 140 is connected to the connector 112 provided on the LED control substrate 110, and the other end of the flat cable 140 is connected to the connector 101 provided on the main substrate 100. More specifically, the flat cable is drawn, in the upper cover 11, leftwardly from the left end portion of the LED control substrate 110, which is a side where the main substrate 100 is disposed. And, the drawn flat cable is bent from left to rear and extends further rearwardly. Further, the flat cable 140 is wrapped over the rear of the pivotal shaft 12, to thus enter the main housing 10, turn to the front, undergo leftward bent, and be finally connected to the connector 101.

The above wiring configuration will be described more simply. As shown in FIG. 4, in the color printer 1, the main substrate 100 provided in the main housing 10 and the LED control substrate 110 provided in the upper cover 11 are electrically connected to each other via the single flat cable 140. The four flat cables 130A to 130D are drawn from the LED control substrate 110 and electrically connected to the respective LED units 40 (the LED heads 41). Specifically, the four flat cables 130A to 130D connected to the respective LED heads 41 are brought together at the LED control substrate 110, and the flat cables are connected to the main substrate 100, via the single flat cable 140 including the signal lines, the number of which is small. Additionally, power for driving the respective LED units 40 (LED heads 41) is supplied with using the four flat cables 130A to 130D.

In the present exemplary embodiment, power for driving the respective LED units 40 (LED heads 41) is supplied from a power substrate 150 disposed separately from the main substrate 100 in the main housing 10 via a cable 151 independent from the flat cable 140. The cable 151 drawn from the power substrate 150 is connected to a power connector 113 provided on the LED control substrate 110. The LED control substrate 110 supplies the power from the power connector 113 to the respective LED units 40 (LED heads 41) with using the four flat cables 130A to 130D.

According to the above configuration of this exemplary embodiment, the following effects can be achieved.

The main substrate 100 and the LED control substrate 110 are connected to each other via the single flat cable 140, and the LED control substrate 110 and the respective LED heads 41, both of which are provided on the upper cover 11, are connected via the flat cables 130A to 130D. Therefore, the LED control substrate 110 can apply power for driving the LED heads 41 to the flat cables 130A to 130D. That is, for the flat cable 140, it is necessary to flow only a signal, such as image data. In other words, the flat cable 40 is not used for supplying power for driving the respective LED units 40 (LED heads 41).

As a result, comparing with the case where the main substrate 100 and the respective LED units 40 (LED heads 41) would be directly connected to each other with using four flat cables 130A to 130D, the length of the flat cables 130A to 130D which connect the LED control substrate 110 to the LED heads 41, respectively, becomes shorter. That is, the usage of the flat cables 130A to 130D for high power, which needs an expensive shield member, can be reduced in the entire apparatus. Additionally, since the length of the flat cables 130A to 130D can be shorter, noise arising in the flat cables 130A to 130D cab be diminished. Consequently, a necessity for covering the flat cables 130A to 13D with a shield member, such as aluminum, is obviated (or areas to be covered can be reduced), and therefore, wiring can be made cost efficiently.

Further, since the total number of signal lines included in the flat cable 140 is smaller than the total number of signal lines included in the four flat cables 130A to 130D, the width of the flat cable 140 can be smaller. As a result, comparing with the case where the main substrate 100 and the respective LED heads 41 are directly connected to each other, that is, the case where a large-size cable into which four flat cables are tied into a bundle is used, for example, a space in the upper cover 11 and a space in the main housing 10, which are used for routing the cable, can be reduced. Consequently, the upper cover 11 and the main housing 10 can be miniaturized, and the color printer 1 can be miniaturized. Moreover, since the flat cable 140 of smaller width can be used, routing of the cable around the pivotal shaft 12 becomes effectively.

In particularly, in the present exemplary embodiment, the flat cable 140 is a single cable, and therefore, the cable can be more readily arranged (routed) in the upper cover 11 and the main housing 10 as compared with the case where four flat cables 130A to 13D would be used for directly connecting the main substrate 100 to the respective LED heads 41. Routing of the cable around the pivotal shaft 12 becomes further improved.

Since only a signal, such as image data, flows though the flat cable 140, the amount of noise arising in the cable becomes small. Accordingly, a necessity for sheathing the flat cable 140 with a shield member, such as aluminum, is obviated, and therefore, wiring can be made cost efficiently.

Since the flat cables 130 (130A to 130D) and the flat cable 140 are drawn from the LED control substrate 110 in different directions, influence of noise, such as electromagnetic waves, arising in the flat cables can be diminished. Especially, the influence of noise arising in the high-power flat cable 130 can be prevented affecting the flat cable 140 through which a signal mainly flows. In the present exemplary embodiment, the flat cables are drawn in different directions with respect to the right-and-left direction, miniaturization of the LED control substrate 110 becomes possible. Consequently, the color printer 1 can be miniaturized.

The flat cable 140 is drawn from an end portion of the LED control substrate 110 at a side closest to the side at which the main substrate 100 is disposed. Therefore, the cable (the flat cable 140) laid between the main substrate 100 and the LED control substrate 110 can be shortened. Moreover, since the flat cable 140 and the main substrate 100 are disposed on the same side, wiring can be made effectively.

While the present invention has been shown and described with reference to certain exemplary embodiments thereof, it will be understood by those skilled in the art that various changes in form and details may be made therein without departing from the spirit and scope of the invention as defined by the appended claims.

The present exemplary embodiment provides the case where the upper cover 11 provided so as to be vertically pivotable about the pivotal shaft 12 disposed at the rear side of the main housing 10. However, the cover is not limited to the upper cover. For example, a the upper cover may be configured to slidably move (parallel movement) upwardly. Moreover, the direction in which the cover is opened and covered is not limited to the vertical direction. For example, a cover may be provided on the left or right side surface of the main housing and is opened and covered in the right-and-left direction.

The exemplary embodiment provides the case where the LED heads 41 using LEDs are adopted. However, the present invention is not limited thereto. For example, an exposure unit using Organic Light-Emitting Diode (OLED), fluorescent substances, or the like, may also be adopted in place of the LEDs. Moreover, an exposure unit that includes a plurality of optical shutters (e.g., liquid-crystal elements, PLZT elements, and the like) arranged for controlling light from a single or a plurality of light sources and that selectively controls an opening and closing time of the optical shutters on the basis of image data.

The exemplary embodiment provides the case where the flat cables 130 and 140 are adopted. However, the present invention is not limited thereto. For example, the flexible flat cables (FFC), and the like may be used in place of the flat cables 130 and 140. Although no mentioned is particularly made to the signal lines, each signal line may be configured by a single lead wire or a multi-lead wire.

Although the exemplary embodiment provides the case where the flat cables 130 and 140 are drawn in opposite directions along the right-to-left direction, the way to draw the cables is not limited to this. For example, if the flat cable 140 is drawn from the left end portion of the LED control substrate 110, the flat cable 130 may be drawn from the front end portion or the rear end portion of the LED control substrate 110. Moreover, the flat cables 130 and 140 may be drawn from an end portion on the same side of the LED control substrate 110.

The exemplary embodiment provides the case where the main substrate 100 is disposed on the left surface of the main housing 10. However, the location of the main substrate 100 is not limited to the left surface but may also be disposed on, for example, the right surface of the main housing. In this case, the flat cables 130 is desirably drawn from the right end portion of the LED control substrate 110. Further, the main substrate 100 may also be disposed on the rear of the main housing.

The exemplary embodiment provides the case where the main substrate 100 is arranged so that the substrate surface (the circuit surface) of the substrate is oriented in the right-and-left direction in the main housing 10. However, the present invention is not limited thereto. For example, in the case where the main substrate is arranged on the rear surface of the main housing, the substrate surface (the circuit surface) can also be oriented in the front-to-rear direction. Alternatively, the main substrate may also be laid in the main housing; namely, the substrate surface (the circuit surface) may be vertically oriented.

The exemplary embodiment provides the configuration in which the flat cable 140 is wrapped over the rear of the pivotal shaft 12, to thus enter the lower main housing 10. However, the present invention is not limited thereto. Specifically, no limitations are imposed on the configuration, so long as the layout (wiring) does not interfere with opening and closing actions of the upper cover 11.

The exemplary embodiment provides the configuration in which power of the LED control substrate 110 is supplied from the power substrate 150 separate from the main substrate 100. However, the present invention is not limited thereto. Specifically, power is supplied from the main substrate. In other words, the main substrate also functions as a power substrate.

What is claimed is:

1. An image forming apparatus comprising:

a lower housing including:

a plurality of photosensitive members, and a main substrate;

an upper housing including:

a plurality of exposure units, an exposure control substrate which is configured to control light emission of the plurality of exposure units; and a plurality of first cables which include a plurality of signal lines and electrically couple the exposure control substrate and the plurality of exposure units, a second cable which includes a plurality of signal lines and electrically couples the exposure control substrate and the main substrate; and a hinge which rotatably couples one end of the upper housing to the lower housing, wherein the first cables and the second cable are different in terms of a data transfer rate per at least one signal line and a protocol used in the data transfer, wherein the exposure control substrate is provided to the upper housing so that a centroid of the upper housing is positioned between an opposed end to the one end and a center between the end and the opposed end.

2. The image forming apparatus according to claim 1, wherein the first cables and the second cable extend from the exposure control substrate in opposite directions.

3. The image forming apparatus according to claim 1, wherein the number of signal lines included in the first cables is larger than the number of signal lines included in the second cable.

4. An image forming apparatus comprising:

a lower housing including:

a plurality of photosensitive members;

a main substrate; and a power substrate, an upper housing including:

a plurality of exposure units;

an exposure control substrate which is configured to control light emission of the plurality of exposure units; and a plurality of first cables which include a plurality of signal lines and electrically couple the exposure control substrate and the plurality of exposure units, a second cable which includes a plurality of signal lines and electrically couples the exposure control substrate and the main substrate;

a third cable which electrically couples the exposure control substrate and the power substrate; and a hinge which rotatably couples one end of the upper housing to the lower housing, wherein power for driving the exposure units is supplied to the exposure units from the power substrate through the third cable, the exposure control substrate, and the first cables, wherein the exposure control substrate is provided to the upper housing so that a centroid of the upper housing is positioned between an opposed end to the one end and a center between the end and the opposed end.

5. The image forming apparatus according to claim 4, wherein the first cables and the second cable extend from the exposure control substrate in opposite directions.

6. The image forming apparatus according to claim 4, wherein the number of signal lines included in the first cables is larger than the number of signal lines included in the second cable.

7. An image forming apparatus comprising:

a lower housing including:

a plurality of photosensitive members; and a main substrate, an upper housing including:

a plurality of exposure units;

an exposure control substrate which is configured to control light emission of the plurality of exposure units; and a plurality of first cables which include a plurality of signal lines and electrically couple the exposure control substrate and the plurality of exposure units, a second cable which includes a plurality of signal lines and electrically couples the exposure control substrate and the main substrate; and a hinge which rotatably couples a first end of the upper housing to the lower housing, wherein the upper housing includes a second end opposite to the first end, and wherein the exposure control substrate is provided at a side of the second end with respect to a center between the first end and the second end.

8. The image forming apparatus according to claim 7, wherein the first cables and the second cable extend from the exposure control substrate in opposite directions.

* * * * *